US007681065B2

(12) United States Patent
Li

(10) Patent No.: US 7,681,065 B2
(45) Date of Patent: Mar. 16, 2010

(54) METHOD AND SYSTEM FOR A MESSAGE PROCESSOR SWITCH FOR PERFORMING INCREMENTAL REDUNDANCY IN EDGE COMPLIANT TERMINALS

(75) Inventor: Weidong Li, Cupertino, CA (US)

(73) Assignee: Broadcom Corporation, Irvine, CA (US)

( * ) Notice: Subject to any disclaimer, the term of this patent is extended or adjusted under 35 U.S.C. 154(b) by 1407 days.

(21) Appl. No.: 10/933,988

(22) Filed: Sep. 3, 2004

(65) Prior Publication Data

US 2006/0053327 A1 Mar. 9, 2006

Related U.S. Application Data

(60) Provisional application No. 60/601,887, filed on Aug. 16, 2004.

(51) Int. Cl.
*G06F 1/10* (2006.01)

(52) U.S. Cl. ..... 713/600

(58) Field of Classification Search ..... 713/600
See application file for complete search history.

(56) References Cited

U.S. PATENT DOCUMENTS 4,237,534 A * 12/1980 Felix ..... 710/123
4,985,830 A * 1/1991 Atac et al. ..... 709/239
5,142,682 A * 8/1992 Lemay et al. ..... 710/243
5,297,260 A * 3/1994 Kametani ..... 710/113
5,553,246 A * 9/1996 Suzuki ..... 710/107
5,872,960 A * 2/1999 Oz et al. ..... 713/501
5,907,689 A * 5/1999 Tavallaei et al. ..... 710/110
6,032,247 A * 2/2000 Asghar et al. ..... 712/35
7,159,134 B2 * 1/2007 Soerensen et al. ..... 713/322
7,165,133 B2 * 1/2007 Takeuchi et al. ..... 710/110

* cited by examiner

*Primary Examiner*—Chun Cao
*Assistant Examiner*—Eric Chang
(74) *Attorney, Agent, or Firm*—McAndrews, Held & Malloy, Ltd.

(57) ABSTRACT

Certain embodiments of the invention may be found in a method and system for processing messages. Aspects of the method may comprise receiving at least one signal on a chip that controls switching from a core processor to a DSP. At least a first bus that couples the core processor to a message processor and at least a first clock signal that clocks the core processor may be switched. At least a second bus that couples the DSP to the message processor and at least a second clock signal that clocks the DSP may be switched. When a loss of clock signal from the core processor or the DSP to the message processor is detected, a third clock signal for clocking the message processor may be generated. The message processor switch significantly reduces the amount of bandwidth utilized for transfer of data between the core processor and the DSP and provides incremental redundancy (IR) without high hardware cost and software MIPS, thereby providing significant improvement in system performance.

40 Claims, 4 Drawing Sheets

METHOD AND SYSTEM FOR A MESSAGE PROCESSOR SWITCH FOR PERFORMING INCREMENTAL REDUNDANCY IN EDGE COMPLIANT TERMINALS

CROSS-REFERENCE TO RELATED APPLICATIONS/INCORPORATION BY REFERENCE

This application makes reference to, claims priority to, and claims the benefit of U.S. Provisional Patent Application Ser. No. 60/601,887, filed on Aug. 16, 2004.

The above stated application is incorporated herein by reference in its entirety.

FIELD OF THE INVENTION

Certain embodiments of the invention relate to the processing of information for a communication channel. More specifically, certain embodiments of the invention relate to a method and system for a message processor switch, which may be utilized for performing incremental redundancy.

BACKGROUND OF THE INVENTION

The evolution from wireless based voice only communication networks to wireless based voice and data communication networks has resulted in the development of global system for mobile communications (GSM) and general packet radio service (GPRS) into the enhanced data for global evolution (EDGE) standard. Although speech still remains the dominant service by many cellular service providers, existing systems are being upgraded to provide greater support for data communication via the radio interface.

The GSM standard, for example, provides data services with bit rates up to 14.4 kbps for circuit-switched data and up to 22.8 kbps for packet based (non-circuit switched) data. For GSM, higher bit rates may be achieved utilizing technological advancements such as high-speed circuit-switched data (HSCSD) technology and general packet radio service (GPRS) technology, which are based on the original gaussian minimum shift keying (GMSK) modulation scheme employed by GSM.

Enhanced data for global evolution (EDGE) is an enhancement to GPRS that leverages a new modulation scheme along with various coding and radio link enhancements to provide much higher bit rates and capacity. Due to the higher bit rate and the need to adapt the data protection to the channel and link quality, the EDGE radio link control (RLC) protocol is somewhat different from the corresponding GPRS protocol. Various link quality control (QC) techniques are utilized for adapting the robustness of a radio link to varying channel quality. Link adaptation (LA) and incremental redundancy (IR) are two quality control techniques that may be utilized to adapt the robustness of a radio link to varying channel quality. The link adaptation technique periodically generates estimates of the link quality and accordingly selects an appropriate modulation and coding scheme for handling transmissions over that communication link so as to maximize the corresponding bit error rate.

EDGE utilizes the incremental redundancy quality control technique to adapt the robustness of a radio link to varying channel quality. With incremental redundancy (IR), information may originally be transmitted utilizing as little coding as possible so as to achieve the highest possible bit rate for the link if decoding is immediately successful. However, in instances where this minimal coding results in a failure during the corresponding decoding process, then more coding is added, thereby increasing the redundancy, until the corresponding decoding process succeeds. In this regard, the additional redundant bits increase the amount of bits that have to be sent, thereby decreasing the bit rate and increasing latency.

FIG. 1 is a block diagram of a conventional message processor implementation 102 that is utilized for GSM, GPRS or EDGE systems. Referring to FIG. 1, there is shown a message processing system 102, which comprises core processor block 104, memory block 106, a DSP block 108, and register block 112. The DSP block 108 may comprise a message processor block (MP) 110 and a message processor memory block 114. The conventional message processor implementation 102 of FIG. 1 may be part of a GSM, GPRS or EDGE handset.

The core processor block 104 may be, for example, a conventional ARM processor. The memory block 106 may be adapted to store and transfer data to the message processor memory 114. The DSP 108 may be adapted to handle transfer of large quantities of data from the message processor memory 114 to the memory block 106. The register block 112 may comprise a plurality of registers for facilitating transfer of data and memory handling functions. The message processor block (MP) 110 may be utilized to implement various channel encoding and decoding functions, which on a conventional processing system as illustrated in FIG. 1, resides in a DSP subsystem such as DSP 108.

The message processor 110 may be adapted to receive information from a transceiver and decode the received information. The message processor memory 114 may be adapted to store large quantities of data that may be transferred from the memory block 106. During data transmission, the message processor 110 may be adapted to code information to be transmitted using a particular coding algorithm. For incremental redundancy, the message processor 110 may be adapted to incrementally code additional bits of information to mitigate the effects of impairments in a communication link.

The incremental redundancy (IR) function utilized by EDGE requires an extensive amount of processing power and bandwidth. For example, the DSP 108 must handle the transfer of large quantities of data from the message processor memory 114 to the memory block 106. Similarly, the core processor 104 must also handle the transfer of large quantities of data from the memory block 106 to the message processor memory 114. These transfers consume a large portion of the processing bandwidth of the core processor 104 and the DSP 108. Accordingly, the incremental redundancy (IR) function utilized by EDGE makes implementing the message processing function in the DSP 108 an inefficient solution.

In conventional systems, when data is to be transmitted, it must be placed in the message processor 110 by DSP 108. The message processor 110 may then code the data for transmission. After coding, the resulting coded data may be placed in a transmit (Tx) buffer from which it is retrieved for transmission. On the receive side, the received data may be acquired from a receive (Rx) buffer by the message processor 110. The data acquired from the receive buffer may then be decoded by the message processor and transferred to the memory 106 by the DSP 108. The ARM 104 may then acquire the decoded data from the memory 106.

For EDGE, IR allows some or all data to be transmitted when errors occur. IR allows variation of coded data to be retransmitted to compensate or correct data in error. When these variations of coded data are received, the DSP may decode any combination of the previously received data and current variations of the coded data. This requires the previously received data to be stored in the DSP memory. However, the DSP memory is very small and the amount of data that may be stored there is limited. To solve this problem, since the memory 106 may be quite large, the data required for IR may be stored in the memory 106. The ARM processor 104 may therefore combine the previously received data with the current variations of data and store the resulting data back in the memory 106. This combined data may then be acquired by the DSP 108 from the memory 106. All this transfer of data requires a lot of processing cycles, which increases system latency and reduces system performance.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

Certain embodiments of the invention may be found in a method and system for processing messages. Aspects of the method may comprise receiving at least one signal on a chip that controls switching from a first processor to a second processor. At least one bus and one clock signal that couples the first processor to the third processor, or the second processor to the third processor may be switched. When a loss of clock signal from the first processor or the second processor to the third processor is detected, a third clock signal for clocking the third processor may be generated.

When the first processor wants to access the third processor, at least one bit in a first register may be asserted that may control the switching from the first processor to the second processor. A select signal may be generated in response to detecting the asserted bit in the first register, which may be utilized to select between the first processor and the second processor. An enable signal may be generated in response to detecting the asserted first bit in the first register, that may enable the first processor to access the third processor. At least a first clock signal may be received from the first processor. In response to receiving the first clock signal from the first processor and a select signal and an enable signal from a state machine, at least a second clock signal may be generated by the switch module. The second clock signal may be communicated to a state machine. A first bus that couples the first processor to a switch module may be enabled and a second bus coupling the DSP to the switch module may be disabled. A clock enable signal may be generated in response to receiving the second clock signal and a signal enabling the first bus, wherein the second clock signal may be adapted to clock the third processor.

When the second processor wants to access the third processor, at least one bit in a second register may be asserted that may control the switching from the first processor to the second processor. A select signal may be generated in response to detecting the asserted bit in the second register, which may be utilized to select between the first processor and the second processor. An enable signal may be generated in response to detecting the asserted bit in the second register, that may enable the second processor to access the third processor. At least a third clock signal may be received from the second processor. In response to receiving the third clock signal from the second processor and a select signal and an enable signal from a state machine, at least a second clock signal may be generated by the switch module. The second clock signal may be communicated to a state machine. A second bus that couples the second processor to a switch module may be enabled and a first bus coupling the DSP to the switch module may be disabled. A clock enable signal may be generated in response to receiving the second clock signal and a signal enabling the second bus, wherein the second clock signal may be adapted to clock the third processor. The first processor may be a core processor, the second processor may be a DSP and the third processor may be a message processor.

Another embodiment of the invention may provide a machine-readable storage, having stored thereon, a computer program having at least one code section executable by a machine, thereby causing the machine to perform the steps as described above for processing messages.

In accordance with another embodiment of the invention, a system for processing messages may be provided. In this regard, the system may comprise circuitry that receives at least one signal on a chip that controls switching from a first processor to a second processor. The circuitry may be adapted to switch at least one bus and one clock signal that couples the first processor to the third processor, or the second processor to the third processor. The system may comprise circuitry that may detect a loss of clock signal from the first processor or the second processor to the third processor, and in response, the circuitry may be adapted to generate a third clock signal for clocking the third processor.

To facilitate access by the first processor to the third processor, the system may comprise circuitry that may be adapted to assert at least one bit in a first register that may control the switching from the first processor to the third processor. The circuitry may be adapted to generate a select signal in response to detecting the asserted bit in the first register, which may be utilized to select between the first processor and a second processor. An enable signal may be generated by the circuitry in response to detecting the asserted first bit in the first register, which may enable the first processor to access the third processor. A switch module may receive at least a first clock signal from the first processor. In response to receiving the first clock signal from the first processor and a select signal and an enable signal from a state machine, the switch module may be adapted to generate at least a second clock signal. The system may comprise circuitry that communicates the second clock signal to a state machine. The system may further comprise circuitry that enables a first bus that couples the first processor to a switch module and disable a second bus coupling the DSP to the switch module. A state machine may generate a clock enable signal in response to receiving the second clock signal and a signal enabling the first bus, wherein the second clock signal may be adapted to clock the third processor.

When the second processor wants to access the third processor, the system may comprise circuitry that may be adapted to assert at least one bit in a second register that may control the switching from the first processor to the second processor. The circuitry may be adapted to generate a select signal in response to detecting the asserted bit in the second register, which may be utilized to select between the first processor and the second processor. An enable signal may be generated by the circuitry in response to detecting the asserted bit in the second register, that may enable the second processor to access the third processor. The switch module may be adapted to receive at least a third clock signal from the second processor.

In response to receiving the third clock signal from the second processor and a select signal and an enable signal from a state machine, the switch module may be adapted to generate at least a second clock signal. The system may comprise circuitry that communicates the second clock signal to a state machine. The system may further comprise circuitry that enables a second bus that couples the second processor to a switch module and disable a first bus coupling the DSP to the switch module. A state machine may generate a clock enable signal in response to receiving the second clock signal and a signal enabling the second bus, wherein the second clock signal may be adapted to clock the third processor.

These and other advantages, aspects and novel features of the present invention, as well as details of an illustrated embodiment thereof, will be more fully understood from the following description and drawings.

DETAILED DESCRIPTION OF THE INVENTION

Certain embodiments of the invention may be found in a method and system for a message processor switch, which may be utilized for performing incremental redundancy. In accordance with an embodiment of the invention, the message processor switch may be adapted to handle various processing requests from both a DSP and a core processor, for example, an ARM processor. In this regard, the DSP and ARM processor share the processing capability provided by the message processor. The message processor significantly reduces the amount of bandwidth utilized for transfer of data from the core processor to the DSP and from the DSP to the core processor for incremental redundancy. A switch is placed between the ARM processor and the DSP, that facilitates transfer of data between the ARM processor, the DSP, and the message processor. In this regard, the ARM processor and the DSP may more efficiently share the resources provided by the message processor. The message processor switch in accordance with the various aspects of the invention provides incremental redundancy (IR) without high hardware cost and software MIPS, thereby providing significant improvement in system performance.

Figure 1:
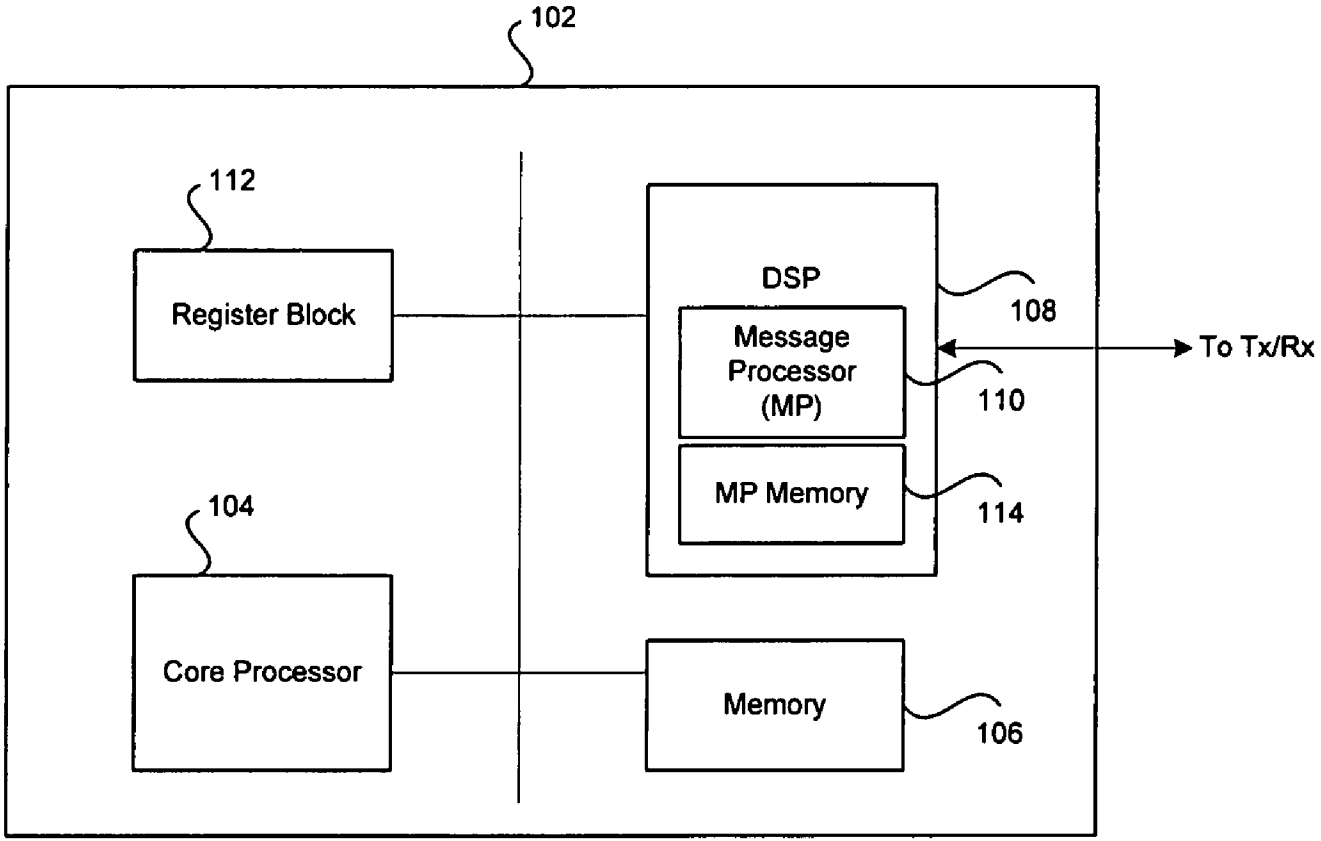
FIG. 1 is a block diagram of a conventional message processor implementation 102 that is utilized for GSM/GPRS/EDGE systems.
Figure 2:
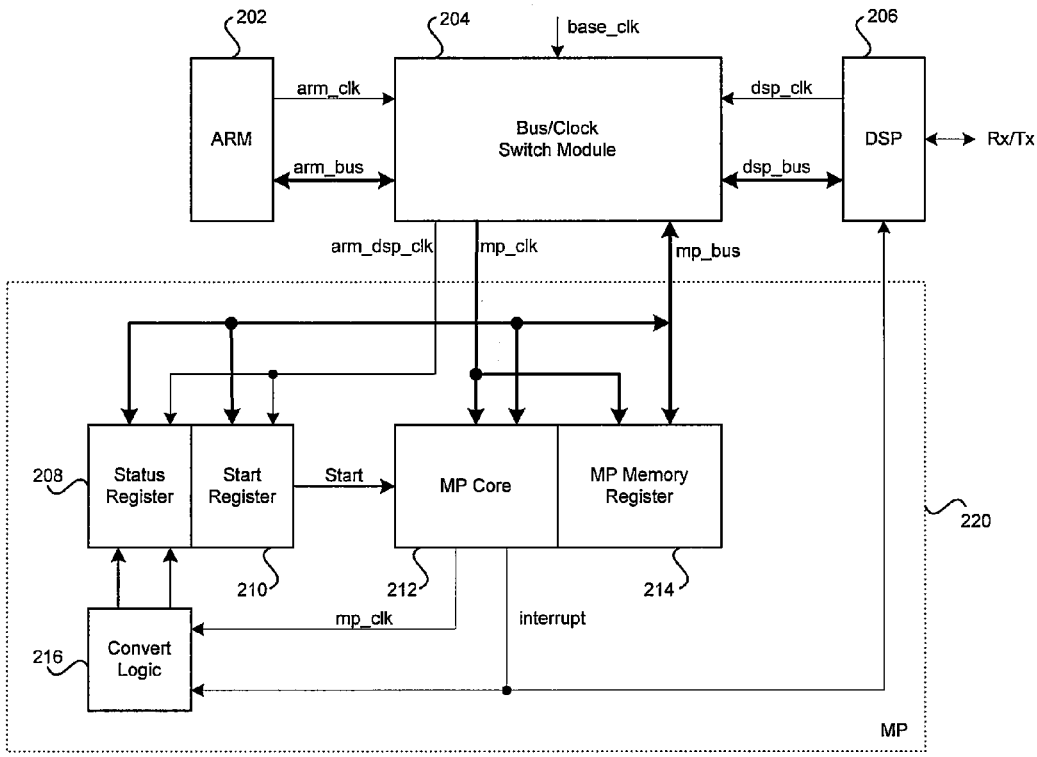
FIG. 2 is a block diagram of a bus clock switch module that may be utilized for performing Incremental Redundancy (IR) in EDGE compliant terminals in accordance with an embodiment of the invention.

FIG. 2 is a block diagram of a bus clock switch module that may be utilized for performing incremental redundancy (IR) in EDGE compliant terminals in accordance with an embodiment of the invention. Referring to FIG. 2, there is shown a core processor 202, a bus/clock switch module 204, a DSP 206, and a message processor block 220. The message processor block 220 may comprise status register block 208, start register block 210, message processor (MP) core block 212, message processor memory register block 214 and conversion logic block 216.

The core processor 202 may be, for example, an ARM processor or other suitable type of processor, which may be adapted to handle system level application type processing. Throughout this document, the core processor 202 will be referred to as an ARM processor, although it should readily be understood that the invention is not limited to the core processor 202 being an ARM processor.

The bus/clock switch module 204 may comprise suitable logic, circuitry and/or code that may be adapted to switch access to the message processor 220 between the ARM processor 202 and the DSP 206. The DSP 206 may be a high speed arithmetic processor utilized to transfer data to and from the message processor 220. The DSP 206 may be adapted to handle low level processing such as coding information for transport over the physical layer and decoding information received from the physical layer. For the GSM/GPRS function, the DSP 206 may be utilized to couple various DSP transceiver ports with a receiver (Rx) and transmitter (Tx).

The message processor block 220 may comprise suitable logic, circuitry and/or code that may be adapted to implement channel coding/decoding function for a GSM/GPRS/EDGE handset. The status register block 208 may comprise suitable logic and circuitry that may be adapted to control and/or provide status of the message processor 220. The status register 208 may be utilized to indicate when the message processor 220 is busy or is available for processing. The start register block 210 may comprise suitable logic and/or circuitry that may be adapted to initiate a start signal to the message processor core 212.

The message processor (MP) core block 212 may comprise suitable logic and/or circuitry that may be adapted to handle message processing. The message processor (MP) memory and register block 214 may comprise suitable logic and/or circuitry that may be adapted to store information for processing. One or more registers may be utilized for management and control functions. The conversion logic block 216 may comprise suitable logic and circuitry that may be adapted to update the status register 208.

The bus clock switch module 204 may be controlled and/or managed by one or more control registers and/or status registers. These control registers and status registers may be utilized for device configuration and also for providing status information. A base clock signal base_clk coupled to the bus/clock switch module 204 provides a clock signal to the message processor 220 when the DSP 206 or the ARM processor 202 clocks are not providing clock signals. The base clock signal base_clk is utilized to drive the message processor 220. There may be instances when the DSP 206 may enter a power saving mode, for example, a sleep mode, while accessing the message processor 220 resulting in a loss of clock signal to the message processor 220. In this case, the bus clock switch module 204 may utilize the base_clk to drive the message processor 220. Similarly, if the ARM processor 202 enters a power saving mode, for example, a sleep mode, which causes a loss of its clock signal, then the bus clock switch module 204 may switch to the base clock signal (base_clk) in order to utilize the base clock to drive the message processor 220. If the message processor 220 loses its clock signal from the DSP 206 or the ARM 202, the message processor 220 may generate an interrupt, which causes the bus clock switch module 204 to supply the base_clk signal to the message processor 220.

The bus clock switch module 204 provides the core processor (ARM) 202 with the capability to access the message processor's memory during incremental redundancy operations, thereby allowing the core processor 202 to have full control and management of IR related information. Additionally, the bus clock switch module 204 provides the DSP 206 with the capability to access the message processor's memory during incremental redundancy operations, thereby allowing the DSP 206 to have full control and management of IR related information. Accordingly, the bus clock switch module 204 provides a shared access capability to incremental redundancy related information without the need for expensive hardware.

Whenever the ARM processor 202 or the DSP 206 requires access to the message processor (MP) 220, they may be required to request access to the MP 220 from the bus clock switch module 204. The bus clock switch module 204 may utilize an arbitration mechanism to resolve any conflicts that may arise with respect to accessing the MP 220. For example, if the DSP 206 is using the MP 220, the bus clock switch module 204 will prevent the ARM 202 from gaining access to the MP 220. Similarly, if the ARM 202 is using the MP 220, then the bus clock switch module 204 will prevent the DSP 206 from accessing the MP 220. After the DSP 206 or ARM processor 202 is granted access to utilize the message processor 220, whichever device that is granted access to utilize the MP 220, may read and/or write to the corresponding memory and registers. Whenever the device that is granted access to use the message processor 220 has completed its task, then that device may generate an interrupt indicating that the message processor 220 is not busy.

Figure 3:
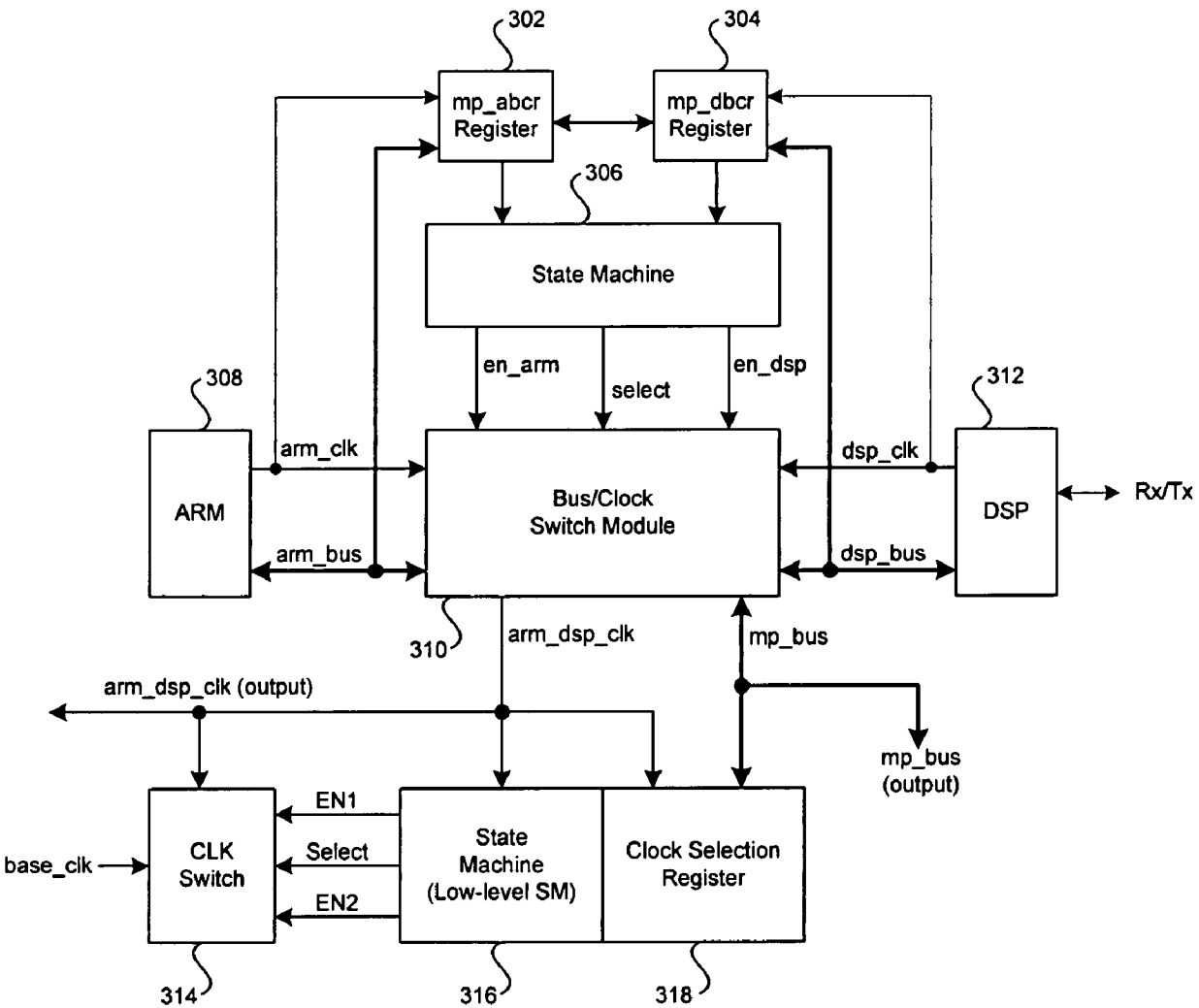
FIG. 3 is a block diagram of the bus clock switch module 204 of FIG. 2, in accordance with an embodiment of the invention.

FIG. 3 is a block diagram of the bus clock switch module 204 of FIG. 2, in accordance with an embodiment of the invention. Referring to FIG. 3, there is shown registers 302, 304, state machine 306, core processor 308, bus clock switch module 310, DSP 312, clock (CLK) switch 314, state machine 316 and clock selection register 318.

Register 302 is a message processor core processor control register (mp_abcr) that may enable the core processor 308 to access the message processor's registers and memory. Table 1a illustrates an exemplary layout of a message processor's core processor control register (mp_abcr), in accordance with an embodiment of the invention.

TABLE 1a

| | Bit | | | | | |
|---|---|---|---|---|---|---|
| | 15:5 | 4 | 3 | 2 | 1 | 0 |
| Function | RESERVED | MP_STAT | MPBUS | D_REQ | A_GRANT | A_REQ |
| Default | XX | 0 | 0 | 0 | 0 | 0 |
| Type | R | R | R | R | R | R/W |

Referring to Table 1a, the MP ARM control register (mp_abcr_reg) 302 may be represented by a 16 bit register in which bit positions 0-4 are utilized and bits 5-15 are reserved.

Table 1b provides a description of the various bits in the message processor's ARM control register (mp_abcr) 302, in accordance with an embodiment of the invention.

TABLE 1b

| Bit # | Name | Functional description |
|---|---|---|
| 0 | A_REQ | 0: ARM disengage MP control<br>1: ARM request MP control |
| 1 | A_GRANT | 0: A status indicating MP bus is not granted to ARM<br>1: A status indicating MP bus is granted to ARM; status will be reset to zero when A_REQ is set to zero. |

TABLE 1b-continued

| Bit # | Name | Functional description |
|---|---|---|
| 2 | D_REQ | 0: A status indicating MP bus is not being requested by DSP<br>1: A status indicating MP bus is being requested by DSP |
| 3 | MPBUS | 0: A status indicating MP bus is currently assigned to ARM<br>1: A status indicating MP bus is currently assigned to DSP |
| 4 | MP_STAT | 0: Status indicating MP is not busy<br>1: Status indicating MP is in operation or is in bus switching |

The A_REQ bit is a read/write bit that, when asserted, indicates that the ARM 308 is requesting control of the message processor 220 (FIG. 2). When the A_REQ bit is deasserted, the ARM 308 disengages or relinquishes control of the message processor 220.

The A_GRANT bit is a read only status bit, that when deasserted, indicates that the MP bus is not granted to the ARM processor 308. However, when the A_GRANT bit is asserted, this indicates that the MP bus is granted to ARM processor 308. The A_GRANT bit may be deasserted or reset whenever the A_REQ bit is deasserted.

The D_REQ bit is a read only status bit, that when asserted, indicates that the message processor's bus is being requested by the DSP 312. When the D_REQ bit is deasserted, this indicates that the message processor bus in not being requested by the DSP 312.

The MPBUS bit is a read only status bit, that when asserted, indicates that the message processor bus is currently assigned to the DSP 312. When the MPBUS bit is deasserted, this indicates that the message processor bus is currently assigned to the ARM processor 308.

The MP_STAT bit is a read only status bit, that when asserted, indicates that the message processor 220 is in operation or is bus switching. In other words, when the MP_STAT bit is asserted, this indicates that the message processor 220 is busy. However, when the MP_STAT bit is deasserted, this indicates that the message processor 220 is not busy.

Register 304 is the message processor's DSP control register (mp_dbcr) that enables the DSP 312 to access the message processor's registers and memory during normal GSM operating mode and during GPRS operating mode. Table 2a illustrates an exemplary layout of the message processor DSP control register (mp_dbcr) 304, in accordance with an embodiment of the invention.

TABLE 2a

| | Bit | | | | | |
|---|---|---|---|---|---|---|
| | 15:5 | 4 | 3 | 2 | 1 | 0 |
| Function | RESERVED | MP_STAT | MPBUS | D_REQ | A_GRANT | A_REQ |
| Default | XX | 0 | 0 | 0 | 0 | 0 |
| Type | R | R | R | R | R | R/W |

Referring to Table 2a, the MP DSP control register (mp_dbcr_reg) 304 may be represented by a 16 bit register in which bit positions 0-4 are utilized and bits 5-15 are reserved.

Table 2b provides a description of the various bits in the message processor's DSP control register (mp_dbcr) 304 of Table 2a, in accordance with an embodiment of the invention.

TABLE 2b

| Bit | Name | Functional description |
|---|---|---|
| 0 | A_REQ | 0: ARM disengage MP control<br>1: ARM request MP control |
| 1 | A_GRANT | 0: A status indicating MP bus is not granted to ARM<br>1: A status indicating MP bus is granted to ARM; status will be reset to zero when A_REQ is set to zero. |
| 2 | D_REQ | 0: A status indicating MP bus is not being requested by DSP<br>1: A status indicating MP bus is being requested by DSP |
| 3 | MPBUS | 0: A status indicating MP bus is currently assigned to ARM<br>1: A status indicating MP bus is currently assigned to DSP |
| 4 | MP_STAT | 0: Status indicating MP is not busy<br>1: Status indicating MP is in operation or is in bus switching |

The A_REQ bit is a read/write bit that, when asserted, indicates that the ARM 308 is requesting control of the message processor 220. When the A_REQ bit is deasserted, the ARM 308 disengages or relinquishes control of the message processor 220.

The A_GRANT bit is a read only status bit, that when deasserted, indicates that the MP bus is not granted to the ARM processor 308. However, when the A_GRANT bit is asserted, this indicates that the MP bus is granted to ARM processor 308. The A_GRANT bit may be deasserted or reset whenever the A_REQ bit is deasserted.

The D_REQ bit is a read only status bit, that when asserted, indicates that the message processor's bus is being requested by the DSP 312. When the D_REQ bit is deasserted, this indicates that the message processor bus in not being requested by the DSP 312.

The MPBUS bit is a read only status bit, that when asserted, indicates that the message processor bus is currently assigned to the DSP 312. When the MPBUS bit is deasserted, this indicates that the message processor bus is currently assigned to the ARM processor 308.

The MP_STAT bit is a read only status bit, that when asserted, indicates that the message processor 220 is in operation or is bus switching. In other words, when the MP_STAT bit is asserted, this indicates that the message processor 220 is busy. However, when the MP_STAT bit is deasserted, this indicates that the message processor 220 is not busy.

The ARM bus control register (mp_abcr) 302 maybe read or written to by the ARM processor 308. The DSP bus control register (mp_dbcr) 304 may be read or written to by the DSP 312.

The state machine 306 is a high level state machine that may be adapted to handle bus switching and may be implemented in hardware. The state machine 306 may receive input signals from the message processor ARM control register (mp_abcr_reg) 302 and the message processor DSP control register (mp_dbcr_reg) 304 and may generate output signals to enable ARM processor (en_arm), select and to enable DSP (en_dsp) signals to the bus clock switch module 310.

The core processor 308 may be an ARM processor or other suitable type of processor which may be adapted to handle system level application type processing. In EDGE mode, the message processor 220 may be switched to handle processing on the ARM 308 side for both transmission and reception. The message processor control register mp_abcr 302 enables the core processor such as an ARM processor 308 to access the message processor memory and registers. Once the core processor 308 is granted access to the message processor 220 and its associated memories, the core processor 308 may then set a message processor configuration register (MP_CFG_REG) to an appropriate mode so as to effectively perform channel coding/decoding.

The bus clock switch module 310 may comprise suitable logic, circuitry and/or code that may be adapted to switch clock signals and bus signals between the ARM processor 308 and the DSP 312 so as to couple them to the message processor 220.

The DSP block 312 is a digital signal processor that may be adapted to handle channel coding and decoding functions. In GSM and GPRS modes, the DSP 312 is adapted to manage and control channel coding during transmission and channel decoding during reception. However, in EDGE mode, the DSP 312 passes up management and control of the channel coding and channel decoding operations to the core processor such as an ARM processor 308. The mp_dbcr register 304 is used to enable the DSP's 312 access to message processor memory and registers while operating in GSM and GPRS modes.

The clock (CLK) switch block 314 may comprise suitable logic, circuitry and/or code that may be adapted to detect loss of clock signal from the ARM processor 308 and the DSP 312. Whenever this loss of clock signal is detected, the clock switch block 314 may supply the base clock signal base_clk to the message processor 220.

The state machine 316 is a low level state machine that may be adapted to handle bus switching and may be implemented in hardware. In general, when clock signals are switched, glitches may occur. The state machine 316 is adapted to mitigate or prevent any glitches from occurring during switching.

The clock selection register 318 is utilized to effectuate the clock switch 314. The clock selection register block 318 may comprise suitable logic, circuitry and/or code that may be adapted to provide clock status and/or facilitate clock switching.

Whenever the ARM 308 wants to access the message processor 220, the ARM 308 may assert a bit in the mp_abcr register 302 and the state machine 306 may detect the assertion of the bit in the mp_abcr register 302. The state machine 306 may then enable the en_arm signal and select signal, thereby giving the ARM 308 access to the message processor 220. In this regard, the bus switch module 310 may switch the arm_clk signal and arm_bus signal and generate an arm_dsp_clk clock signal and mp_bus signal. Once the state machine 316 receives the arm_dsp_clk signal, it may generate one or more enable and/or select signals to the clock switch 314.

On the other hand, whenever the DSP 312 wants to access the message processor 220, the DSP 312 may assert a bit in the mp_abcr register 302 and the state machine 306 may detect the assertion of the bit in the mp_abcr register 302. The state machine 306 may then enable the en_dsp signal and select signal, thereby giving the DSP 312 access to the message processor 220. In this regard, the bus switch module 310 may switch the dsp_clk signal and dsp_bus signal and generate the arm_dsp_clk clock signal and mp_bus signal. Once the state machine 316 receives the arm_dsp_clk signal, it may generate one or more enable and/or select signals to the clock switch 314.

The state machine 306 controls when the bus may be issued to the DSP 312 or the ARM processor 308. Additionally, the state machine 306 is adapted to handle the switching of the clock signals and bus. The state machine 306 may couple the ARM clock signal (arm_clk) to the message processor 220 when the ARM processor 308 is granted access to the message processor 220. The ARM 308 address and data bus may also be coupled to the message processor 220. Also, the state machine 306 may couple the DSP clock signal (dsp_clk) to the message processor 220 when the DSP 312 is granted access to the message processor 220. The DSP's address and data bus may also be coupled to the message processor 220.

Figure 4:
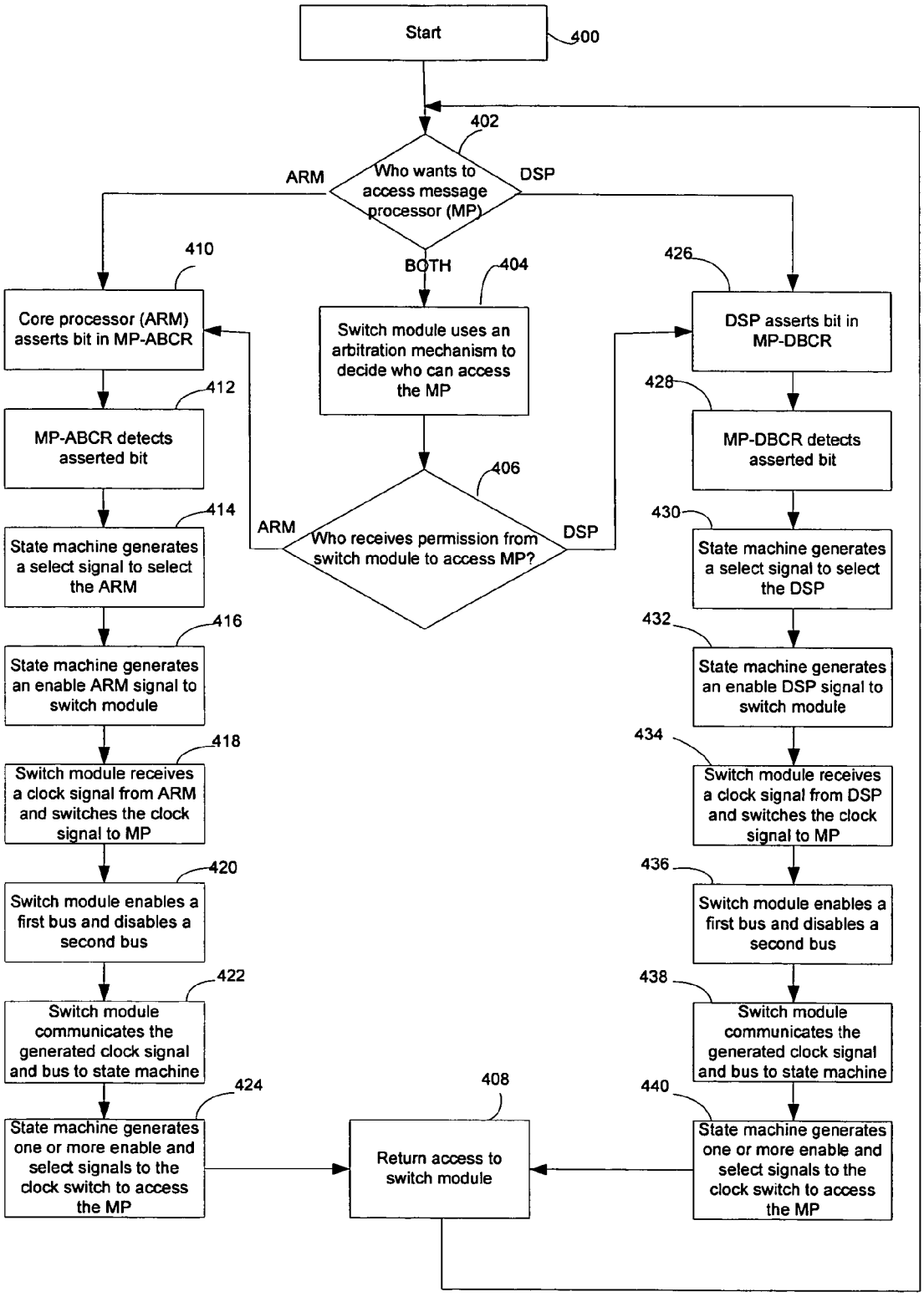
FIG. 4 is a flow chart illustrating exemplary steps that may be utilized for performing Incremental Redundancy (IR) in EDGE compliant terminals in accordance with an embodiment of the invention.

FIG. 4 is a flow chart illustrating exemplary steps that may be utilized for performing Incremental Redundancy (IR) in EDGE compliant terminals in accordance with an embodiment of the invention. Referring to FIG. 4, the exemplary steps start in step 400. Subsequently in step 402, the switch module may receive a signal from either an ARM processor, a DSP or both from an ARM processor and a DSP to access the message processor (MP). If the switch module receives a signal from both the ARM processor and the DSP, in step 404, the switch module may utilize an arbitration mechanism to decide which device may be given permission to access the MP. For example, if the DSP is using the message processor, the switch module may prevent the ARM processor from gaining access to the message processor. Similarly, if the ARM processor is using the message processor, then the switch module may prevent the DSP from accessing the message processor. After the DSP or ARM processor is granted access to utilize the message processor, the device that is granted access to utilize the message processor, may read and/or write to the corresponding memory and registers. In step 406, the message processor may grant permission to either the ARM processor or the DSP after using the arbitration mechanism. In instances where the ARM processor wants to access the message processor or is granted permission to access the message processor after the switch module uses an arbitration mechanism, then control passes to step 410. In step 410, the core processor (ARM) may assert a bit in the message processor's core processor control register (mp_abcr). In step 412, the asserted bit may be detected by the mp_abcr. In step 414, a signal may be generated by a state machine, which may be utilized to select the ARM processor. In step 416, the state machine may generate an enable ARM signal to the switch module. In step 418 and step 420, the switch module may receive a clock signal from the ARM processor and enable a first bus coupled between the ARM processor and the switch module and disable a second bus coupled between the DSP and the switch module. In step 422, the switch module may communicate the generated clock signal as an input to a state machine. In step 424, the state machine may generate one or more enable and select signals to the clock switch to access the message processor, in response to receiving the switched clock signal and a signal enabling the first bus from the switch module. When the ARM processor has completed transfer of data to and from the message processor it may pass control back to the switch module. In step 408, the ARM processor may return access to the switch module and the exemplary steps may be repeated beginning at step 402.

In instances where the DSP wants to access the message processor or is granted permission to access the message processor after the switch module uses an arbitration mechanism, then control passes to step 426. In step 426, the DSP may assert a bit in the message processor's DSP control register (mp_dbcr). In step 428, the asserted bit may be detected by the mp_dbcr. In step 430, a signal may be generated by a state machine to select the DSP. In step 432, the state machine may generate an enable DSP signal to the switch module. In step 434 and step 436, the switch module may receive a clock signal from the DSP and enable a second bus coupled between the DSP and the switch module and disable a first bus coupled between the ARM processor and the switch module. In step 438, the switch module may communicate the generated clock signal as an input to a state machine. In step 440, the state machine may generate one or more enable and select signals to the clock switch to access the message processor, in response to receiving the switched clock signal and a signal enabling the second bus from the switch module. When the DSP has completed transfer of data to and from the message processor it may pass control back to the switch module. In step 408, the DSP may return access to the switch module and the exemplary steps may be repeated beginning at step 402.

In accordance with the various embodiments of the invention, the message processor switch 310 design solves both DSP 312 and ARM 308 bandwidth problems, which significantly enhance the system performance. Furthermore, the ARM processor 308 and the DSP 312 may be operated at significantly lower speeds to achieve 4-slot EDGE functionality. By placing a switch between the ARM processor and the DSP, the transfer of data between the ARM processor, the DSP, and the message processor may be facilitated. In this regard, the ARM processor and the DSP may more efficiently share the resources provided by the message processor. The message processor switch in accordance with the various aspects of the invention provides incremental redundancy (IR) without high hardware cost and software MIPS, thereby providing significant improvement in system performance.

Accordingly, the present invention may be realized in hardware, software, or a combination of hardware and software. The present invention may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A method for processing messages, the method comprising:

receiving at least one signal on a chip from one or both of a first processor and/or a second processor, to access a third processor;

switching to at least a first bus that couples said first processor to said third processor and switching to at least a first clock signal that clocks said first processor to said third processor when said at least one signal is received from said first processor; and switching to at least a second bus that couples said second processor to said third processor and switching to at least a second clock signal that clocks said second processor to said third processor when said at least one signal is received from said second processor.

2. The method according to claim 1, comprising detecting loss of said first clock signal.

3. The method according to claim 2, comprising generating at least a third clock signal for clocking said third processor in response to said detected loss of said first clock signal.

4. The method according to claim 1, comprising detecting loss of said second clock signal.

5. The method according to claim 4, comprising generating at least a third clock signal for clocking said third processor in response to said detected loss of said second clock signal.

6. The method according to claim 1, comprising:

asserting at least a first bit in at least a first register when said at least one signal is received from said first processor;

detecting said asserted first bit in said first register;

receiving a generated select signal in response to detecting said asserted first bit in said first register that selects said first processor; and receiving a generated enable signal in response to detecting said asserted first bit in said first register that enables said first processor to access said third processor.

7. The method according to claim 6, comprising receiving said first clock signal from said first processor.

8. The method according to claim 7, comprising generating at least a third clock signal in response to said received first clock signal from said first processor.

9. The method according to claim 8, comprising communicating said generated third clock signal as an input to a state machine.

10. The method according to claim 9, comprising enabling said first bus coupling said first processor and a switch module and disabling said second bus coupling said second processor and said switch module in response to receiving said generated select signal and receiving said generated enable signal.

11. The method according to claim 1, comprising:

asserting at least a second bit in at least a second register when said at least one signal is received from said second processor;

detecting said asserted second bit in said second register;

receiving a generated select signal in response to detecting said asserted second bit in said second register that selects said second processor; and receiving a generated enable signal in response to detecting said asserted second bit in said second register that enables said second processor to access said third processor.

12. The method according to claim 11, comprising receiving said second clock signal from said second processor.

13. The method according to claim 12, comprising generating at least a third clock signal in response to said received second clock signal from said second processor.

14. The method according to claim 13, comprising communicating said generated third clock signal as an input to a state machine.

15. The method according to claim 14, comprising enabling said second bus coupling said second processor and a switch module and disabling said first bus coupling said first processor and said switch module in response to receiving said generated select signal and receiving said generated enable signal.

16. The method according to claim 1, wherein said first processor is a core processor.

17. The method according to claim 1, wherein said second processor is a DSP.

18. The method according to claim 1, wherein said third processor is a message processor.

19. The method according to claim 1, comprising utilizing an arbitration mechanism to determine whether said first processor or said second processor is granted said access to said third processor when said at least one signal is received from both of said first processor and said second processor.

20. A machine-readable storage having stored thereon, a computer program having at least one code section for processing messages the at least one code section being executable by a machine for causing the machine to perform steps comprising:

receiving at least one signal on a chip from one or both of a first processor and/or a second processor, to access a third processor;

switching to at least a first bus that couples said first processor to said third processor and switching to at least a first clock signal that clocks said first processor to said third processor when said at least one signal is received from said first processor; and switching to at least a second bus that couples said second processor to said third processor and switching to at least a second clock signal that clocks said second processor to said third processor when said at least one signal is received from said second processor.

21. The machine-readable storage according to claim 20, comprising code that enables utilization of an arbitration mechanism to determine whether said first processor or said second processor is granted said access to said third processor when said at least one signal is received from both of said first processor and said second processor.

22. A system for processing messages, the system comprising:

circuitry that enables receipt of at least one signal on a chip from one or both of a first processor and/or a second processor, to access a third processor;

circuitry that enables switching to at least a first bus that couples said first processor to said third processor and switching to at least a first clock signal that clocks said first processor to said third processor when said at least one signal is received from said first processor; and circuitry that enables switching to at least a second bus that couples said second processor to said third processor and switching of to at least a second clock signal that clocks said second processor to said third processor when said at least one signal is received from said second processor.

23. The system according to claim 22, comprising circuitry that enables detection of loss of said first clock signal.

24. The system according to claim 23, comprising circuitry that enables generation of at least a third clock signal for clocking said third processor in response to said detected loss of said first clock signal.

25. The system according to claim 22, comprising circuitry that enables detection of loss of said second clock signal.

26. The system according to claim 25, comprising circuitry that enables generation of at least a third clock signal for clocking said third processor in response to said detected loss of said second clock signal.

27. The system according to claim 22, comprising:

circuitry that enables assertion of at least a first bit in at least a first register when said at least one signal is received from said first processor;

circuitry that enables detection of said asserted first bit in said first register;

circuitry that enables receipt of a generated select signal in response to detecting said asserted first bit in said first register that selects said first processor; and circuitry that enables receipt of a generated enable signal in response to detecting said asserted first bit in said first register that enables said first processor to access said third processor.

28. The system according to claim 27, comprising a switch module that receives said first clock signal from said first processor.

29. The system according to claim 28, wherein said switch module enables generation of at least a third clock signal in response to said received first clock signal from said first processor.

30. The system according to claim 29, comprising circuitry that enables communication of said generated third clock signal as an input to a state machine.

31. The system according to claim 30, comprising circuitry that enables said first bus coupling said first processor and said switch module and circuitry that disables said second bus coupling said second processor and said switch module in response to receiving said generated select signal and receiving said generated enable signal.

32. The system according to claim 22, comprising:

circuitry that enables assertion of at least a second bit in at least a second register when said at least one signal is received from said second processor;

circuitry that enables detection of said asserted second bit in said second register;

circuitry that enables receipt of a generated select signal in response to detecting said asserted second bit in said second register that selects said second processor; and circuitry that enables receipt of a generated enable signal in response to detecting said asserted second bit in said second register that enables said second processor to access said third processor.

33. The system according to claim 32, comprising a switch module that receives said second clock signal from said second processor.

34. The system according to claim 33, wherein said switch module enables generation of a third clock signal in response to said received second clock signal from said second processor.

35. The system according to claim 34, comprising circuitry that enables communication of said generated third clock signal as an input to a state machine.

36. The system according to claim 35, comprising circuitry that enables said second bus coupling said second processor and said switch module and circuitry that disables said first bus coupling said first processor and said switch module in response to receiving said generated select signal and receiving said generated enable signal.

37. The system according to claim 22, wherein said first processor is a core processor.

38. The system according to claim 22, wherein said second processor is a DSP.

39. The system according to claim 22, wherein said third processor is a message processor.

40. The system according to claim 22, comprising circuitry that enables utilization of an arbitration mechanism to determine whether said first processor or said second processor is granted said access to said third processor when said at least one signal is received from both of said first processor and said second processor.

* * * * *